United States Patent [19]

Sasao et al.

[11] Patent Number: 5,074,800

[45] Date of Patent: Dec. 24, 1991

[54] LOCKING TYPE EJECTION LEVER FOR USE IN A CARD EDGE CONNECTOR

[75] Inventors: Masami Sasao, Kawasaki; Shoji Yamada, Machida, both of Japan

[73] Assignee: Molex Incorporated, Lisle, Ill.

[21] Appl. No.: 610,866

[22] Filed: Nov. 8, 1990

[30] Foreign Application Priority Data

Dec. 4, 1989 [JP] Japan ..... 1-140607[U]

[51] Int. Cl.[5] ..... H01R 13/00

[52] U.S. Cl. ..... 439/157

[58] Field of Search ..... 439/152-160

[56] References Cited

U.S. PATENT DOCUMENTS 3,150,906 9/1964 Chambon et al. ..... 439/157

4,070,081 1/1978 Takahaski ..... 439/157

*Primary Examiner*—Joseph H. McGlynn

*Attorney, Agent, or Firm*—Louis A. Hecht; Stephen Z. Weiss; Charles S. Cohen

[57] ABSTRACT

Disclosed is an improvement in a locking type ejection lever for use in a card edge connector which comprises female receptacle structure and male plug structure integrally connected to a housing of a printed board and a counter printed board to be electrically connected to the printed board, said male plug and female receptacle structure when mated together, making electrical connections between all conductors of said printed boards. A lock mechanism for a card edge connector according to the present invention can attain dual function of locking and ejecting one printed board from the housing of the other printed board, and ejection can be performed with single easy action.

3 Claims, 4 Drawing Sheets

LOCKING TYPE EJECTION LEVER FOR USE IN A CARD EDGE CONNECTOR

BACKGROUND OF THE INVENTION

1. Field of the invention

The present invention relates to a locking type ejection lever for use in a card edge connector, and particularly to an improvement in such a locking type ejection lever which facilitates disconnection and removal of a plate-like object such as a printed board from an associated connector.

2. Description of Prior Art

Plate-like objects, which can be mated together by associated card edge connectors, have been widely used. Such a card edge connector comprises a male plug structure integrally connected to a housing of a plate-like object such as a printed board, and a female receptacle structure integrally connected to another plate-like object. The male plug structure and female receptacle structure, when mated with each other, can make electrical connections between all conductors of these plate-like objects, and at the same time, the male plug structure and female receptacle structure can be locked together.

The locking structure is composed of opposite longitudinal extensions of the housing each having a longitudinal guide slot, and latch arms each rotatably fixed to the end of each longitudinal extension.

The opposite sides of the printed board are inserted in the longitudinal slots of the opposite longitudinal extensions of the housing until the printed board has been completely fitted in the housing. Thereafter the latch arms are resiliently rotated so that they are caught by the holes which are formed in the surface on opposite sides of the lateral edges of the printed board.

This prior art latching structure has been used for a long time, and is found satisfactory. It, however, has the disadvantage of not being able to eject a printed board without requiring many steps to remove the previously locked printed board. In unlatching and removing a printed board from a housing equipped with a prior art card edge connector, first, one latch arm is turned outward to move its tip out of engagement with a lock hole which is made in one corner of the lateral edge of the printed board, and then the printed board is partially pulled up. Second, the other latch arm is turned outward to move its tip out of engagement with a lock hole which is made in the other corner of the lateral edge of the printed board, and then the printed board is also partially pulled up. Thus, the forward lateral edge of the printed board is partially pulled up from the housing while the opposite lock arms turn outward. Then, the printed board is completely pulled out from the housing. The complete removal requires several steps of action.

SUMMARY OF THE INVENTION

An object of the present invention is to provide a card edge connector equipped with locking type ejection levers which permit ejection of one plate-like object from a connector housing with a single easy finger action.

Another object of the present invention is to provide a card edge connector equipped with locking type ejection levers which permit latching and ejection of one plate-like object with the connector housing by lever action.

To attain these and other objects, a locking type ejection lever is provided for use in a card edge connector. The card edge connector comprises a female receptacle structure and male plug structure integrally connected to a housing of a plate-like object such as a printed board and another plate-like object such as another printed board. The male plug structure and female receptacle structure, when mated with each other, make electrical connections between all conductors of said plate-like objects and, at the same time, are locked together. The ejection lever is designed to turn into a locking or an unlocking position selectively, and is pivoted about opposite corners of the connector housing. When the plate-like object is pushed into the housing with the ejection lever put in an unlocking position, the ejection lever turns toward the locking position. In the locking position, the locking part of the ejection lever is forced into engagement with the corresponding corner of the plate-like object. When the ejection lever is made to turn toward the unlocking position, the thrust part of the ejection lever is raised to thrust the housing up and partially out of the connector.

In use, one plate-like object is fixed to an associated housing with the conductors of the plate-like object electrically connected to the receptacle terminals of the housing. The opposite ejection levers are turned outward, and the other plate-like object is located in the entrance slot of the housing while the plate-like object pushes the thrust sections of the ejection levers downward, thereby causing the ejection levers to turn to the locking position. In this locking position, the upper locking sections of the ejection levers are forced into engagement with corresponding corners of the other plate-like object. Thus, the other plate-like object is fastened to the housing. When removal of the other plate-like object from the housing is demanded, the ejection levers are turned outward into the unlocking position. This will push up and raise the other plate-like object out of engagement with the connector.

The other plate-like object is raised up to the level at which all conductor plugs of the other plate-like object are separated from the receptacle terminals of the housing, and the other plate-like object is far enough from the housing that the resilient grip of the receptacle terminals of the housing has no effect on the conductor plugs of the plate-like object. This allows for the easy removal of the plate-like object from the housing.

Other objects and advantages of the present invention Will be understood from the following description of a preferred embodiment of the present invention which is shown in accompanying drawings:

BRIEF DESCRIPTION OF THE INVENTION

DESCRIPTION OF THE PREFERRED EMBODIMENT

Figure 1:
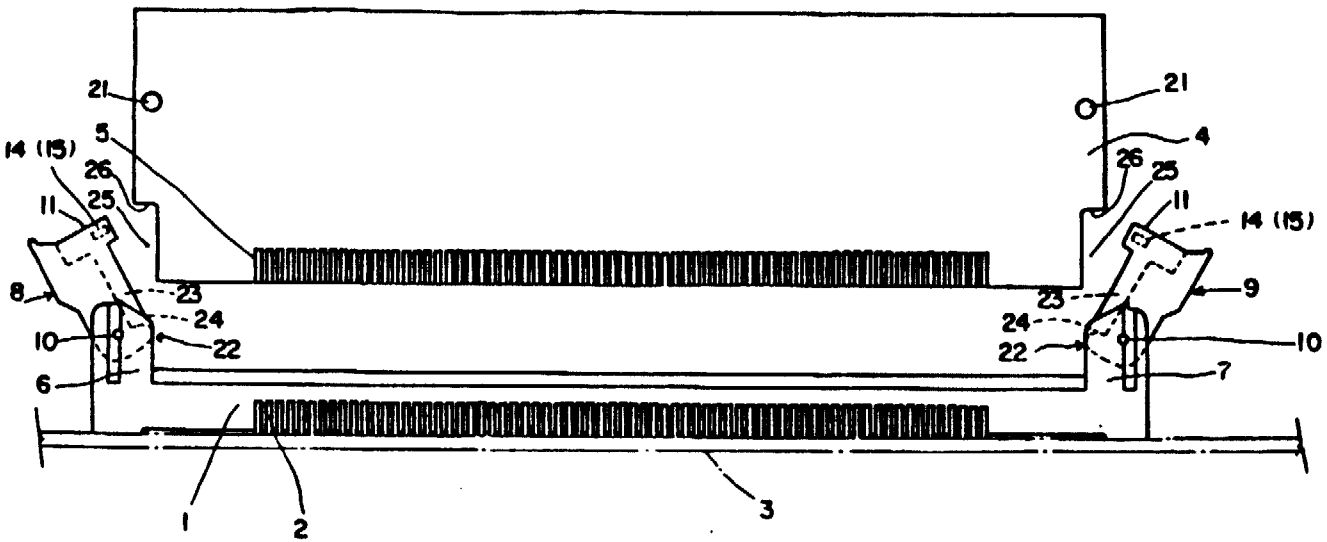
FIG. 1 is a plane view of a printed board and a housing in the position in which they are about to be combined together, or conversely in the position in which the printed board has been ejected and separated from the housing.

Referring now to FIG. 1 to 6, there are shown different relational positions between a first printed board 3 whose housing is equipped with a card edge connector, and a second printed board 4. They are a) combined and locked together, b) ejected and separated, or c) on the way to latching or to removal from each other. Also, referring to FIG. 7 there is shown the ejection lever 8 or 9, and referring to FIG. 8 and subsequent drawings there are shown the ejection lever 8 or 9 at one corner of the housing of the first printed board 3. As seen from these drawings, the housing 1 has a plurality of receptacle terminals 2 at regular intervals on its lateral edge. When the other printed board 4 is inserted in the housing 1, all plug conductors 5 of the other printed board 4 are mated with all receptacle terminals 2 of the housing 1, thus making electrical connections between all conductors 5 of the first printed board 3 and those of the second printed board 4.

The printed board 4 can be locked to the housing 1 of the first printed board 3 with its ejection levers 8 and 9. As seen from the drawings, the housing 1 has longitudinal extensions 6 and 7 integrally connected to the opposite corners of the housing 1, and the ejection levers 8 and 9 are pivoted to the longitudinal extensions 6 and 7 at pivots 10, respectively. These ejection levers 8 and 9 are exactly the same, and are pivoted to the longitudinal extensions 6 and 7 in the same fashion. Therefore, it suffices that one ejection lever 9 is described with reference to FIG. 7 and subsequent drawings. As seen from these drawings, the ejection lever 9 has a lock section 11 in its upper part.

Specifically, the lock section 11 is composed of a pair of parallel lock extensions 12 and 13, defining a lock space 16 therebetween. Each lock extension has a semicylindrical projection 14 or 15 on its upper inner surface. Also, the lock section 11 has two side extensions 17 and 18 adjacent to the lock extensions 12 and 13 with spaces 19 and 20 located between each side extension and adjacent lock extension. The ejection lever 9 has a thrust section 22 at its bottom part. This thrust section 22 is made up by an abutting surface 24 to abut against the flat surface 26 of the notched part 25 on each side of the second printed board 4, and a longitudinal slot 23 extending upright from the abutting surface 24 between opposite side walls 27 and 28. Longitudinal slot 23 is adapted to accommodate one longitudinal edge of a printed board. The longitudinal slot 23 is put in alignment with the pair of lock extensions 12 and 13. In this particular example, the left side extension 17 is integrally connected to the left wall 27 whereas the right side extension 18 is integrally connected to the right wall 28. The notched parts of the housing 1 of the second printed board 4, the sections of the first printed board 3 and ejection lever 8 or 9 are designed so that their shapes and sizes are coordinated as stated below.

First, the flat surfaces 26 of the notched parts of the printed board 4 must come to contact with the abutting surfaces 24 of the thrust sections 22 of the ejection levers 8 and 9 when the printed board 4 is inserted in the entrance space of the housing 1. As the printed board 4 advances in the entrance space of the housing 1, its opposite side edges penetrate the longitudinal slots 23 and contact the thrust sections 22 of the ejection levers 8 and 9. When all plug conductors 5 of the printed board 4 are mated with corresponding receptacle terminals 2 of the housing 1 at the end o insertion, the ejection levers 8 and 9 are made to turn into locking position in which their lock extensions 12 and 13 have snapped into their places with their semicylindrical projections fitted in corresponding slots 21 on the opposite side corners of the housing 1. Conversely, when the ejection levers 8 and 9 are made to turn outward about their pivots 10 after their semicylindrical projections 14 and 15 come out from the slots 21, the thrust sections 22 of the ejection levers 8 and 9 will thrust and raise the printed board 4.

Figure 4:
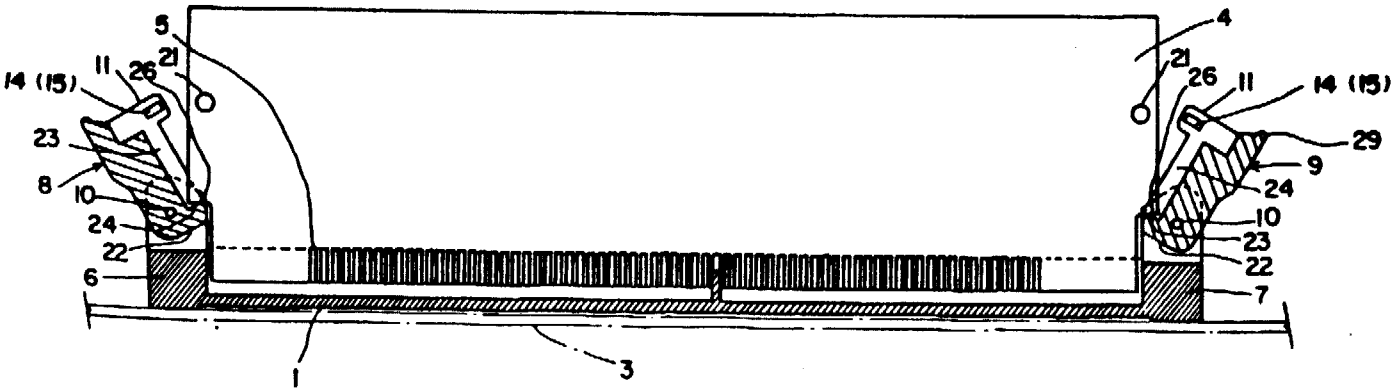
FIG. 4 and 5 are section views showing the printed board on the way to insertion into the housing or conversely on the way to removal from the housing.
Figure 5:
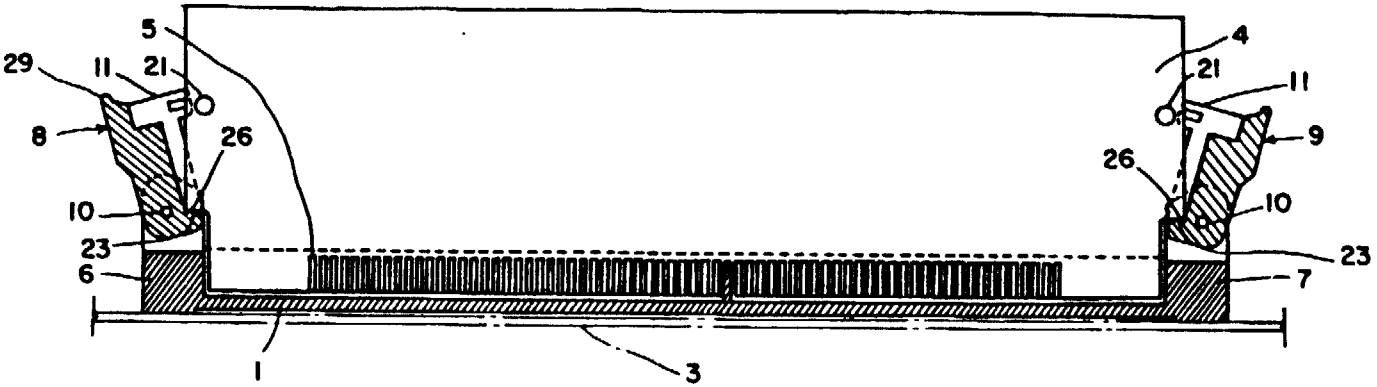

The locking and ejecting operations will be described below with reference to FIG. 1 to 6. First, when the second printed board 4 is inserted in the entrance space of the housing 1 of the first printed board 3 to which the second printed board 4 is to be connected, the second printed board 3 is put in front of the housing 1. The opposite ejection levers 8 and 9 are turned outward into the ejection position. As the printed board 4 is made to advance downwards, the flat surfaces 26 of the opposite, lower notched parts 25 of the printed board 4 will come to contact with the abutting surface 24 of the thrust sections 22 of the ejection levers 8 and 9, as shown in FIG. 4. When the printed board 4 is made to advance further, the abutting surfaces 24 of the thrust sections 22 will be pushed down, thereby causing the ejections levers 8 and 9 to rotate about pivots 10 toward the locking position. As shown in FIG. 5, the left ejection lever 8 turns clockwise whereas the right ejection lever 9 turns counterclockwise. In the position of FIG. 5, all plug conductors 5 of the printed board 4 have not completely mated with corresponding receptacle terminals 2 of the housing 1. Further advance of the printed board 4 will make complete electrical connections between all plug conductors of the printed board 4 and corresponding receptacle terminals 2 of the housing 1. In this position the ejection levers 8 and 9 turn into upright position so that the opposite side edges of the printed board 4 enter the spaces 16 each defined by the lock extensions 12 and 13, as seen from FIG. 2 or 6. On the way to complete insertion, the lock extensions 12 and 13 slidably move on the printed board 4 until their semicylindrical projections 14 and 15 have snapped into the slots 21 of the printed board 4. Thus, the printed board 4 has been locked to the housing 1.

Figure 2:
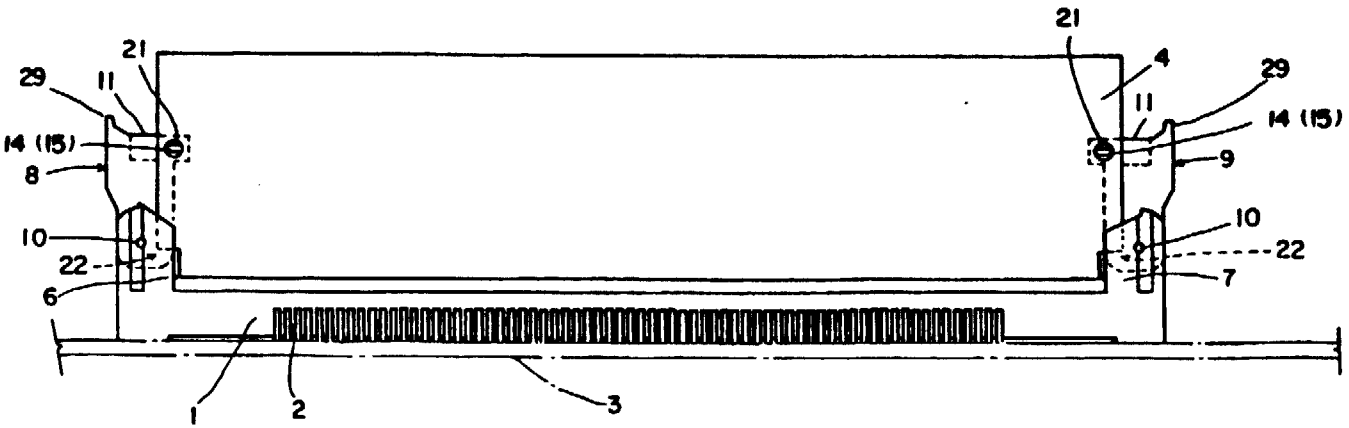
FIG. 2 is a plane view of the printed board and the housing in the locking position.
Figure 3:
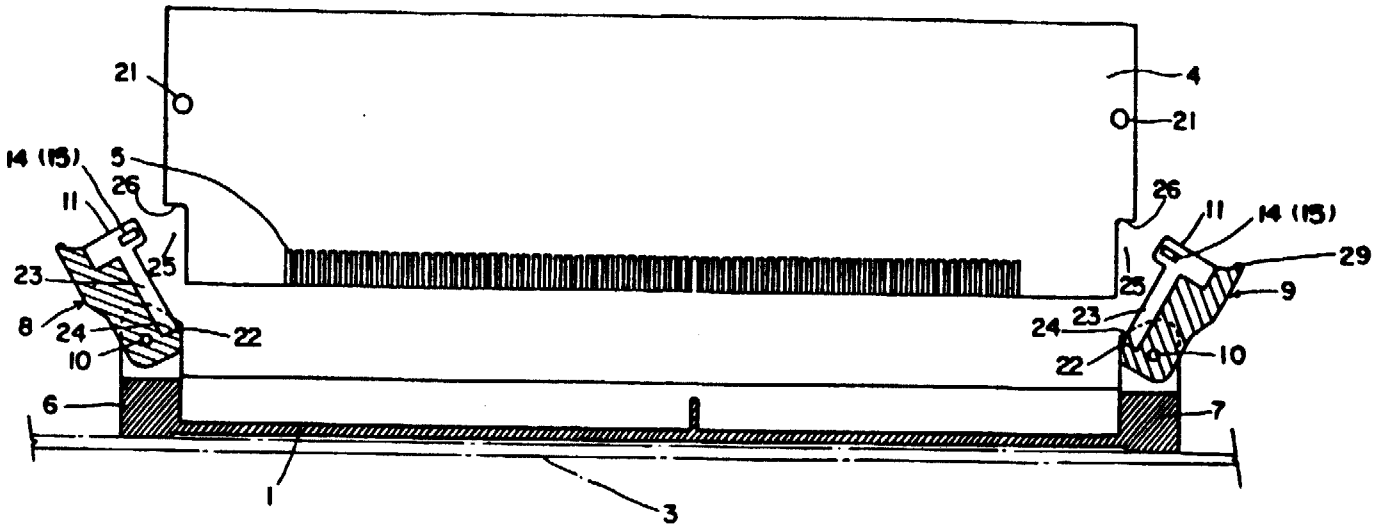
FIG. 3 is a section view showing the printed board as it is about to be fitted in the housing, or the printed board as it is ejected and separated from the housing.
Figure 6:
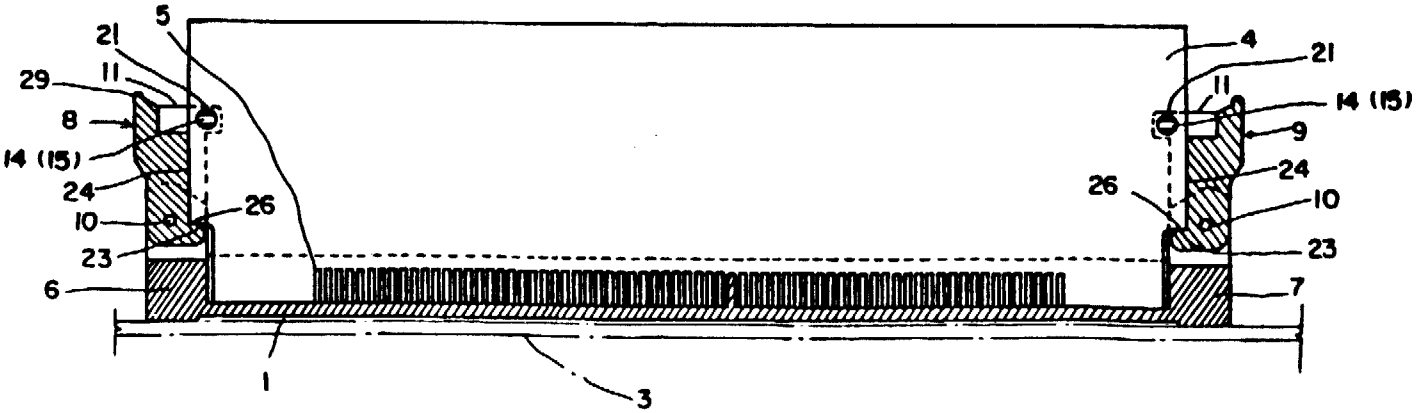
FIG. 6 is a section showing the printed board secured to the housing.

In removing the printed board 4 from the housing 1, the ejection levers 8 and 9 are made to turn from the position of FIG. 2 or 6 toward ejection position of FIG. 1. Specifically, in FIG. 6, the left ejection lever 8 is made to turn counterclockwise whereas the right ejection lever 9 is made to turn clockwise. This can be performed by catching each ejection lever by its riser 29 with a finger and pulling it outward. Then, the semicylindrical projections 14 and 15 of the lock extensions 12 and 13 come out of the slots 21.

On the other hand, rotation of the ejection levers about their pivots 10 will cause the thrust sections 22 of the ejection levers to push up the printed board 4. Specifically, as shown in FIG. 5, the abutting surfaces 24 of the ejection levers 8 and 9 raise the flat surfaces 26 of the notched parts 25 of the printed board 4. Then, the printed board 4 begins to leave the housing 1, as seen from FIG. 5. Further turning of the ejection levers 8 and 9 will cause the printed board 4 to move to the position of FIG. 4, and finally to the position of FIG. 3 in which the printed board 4 has been removed from the housing 1. Thus, ejection is completed.

As may be understood from the above, the lock mechanism to secure a second printed board to the housing of a first printed board to which the second printed board is to be mated, can be used to remove the second printed board from the housing of the first printed board. Ejection of the second printed board can be attained simply by turning the opposite ejection levers by finger. Advantageously, the ejection lever can attain dual function of locking and ejecting a printed board from the housing of another printed board, and ejection can be performed with single easy action.

In the embodiment described above, the ejection levers 8 and 9 are described as being pivoted in relation to longitudinal extensions 6 and 7 of the housing 1. However, the ejection levers 8 and 9 may be pivoted in relation to the opposite corners of the housing 1 if the housing is tall enough. The ejection lever is described as having side extensions 17 and 18 adjacent to lock extensions 12 and 13 respectively, thereby increasing the strength of the whole lever body. These opposite side extensions 17 and 18 may be omitted. Each lock extension may have appropriate catch means other than semicylindric projection. In this particular embodiment a printed board 4 is described as having notched portions 25 at opposite lower corners, and the thrust section of each ejection lever is described as having an abutting bottom 24 to abut against the flat surface 26 of the notched portion 25 of the printed board 4. The notched portion 25, however, may be omitted, and then the abutting bottom 24 of the thrust section will abut against the corresponding corner of the printed board.

Figure 7:
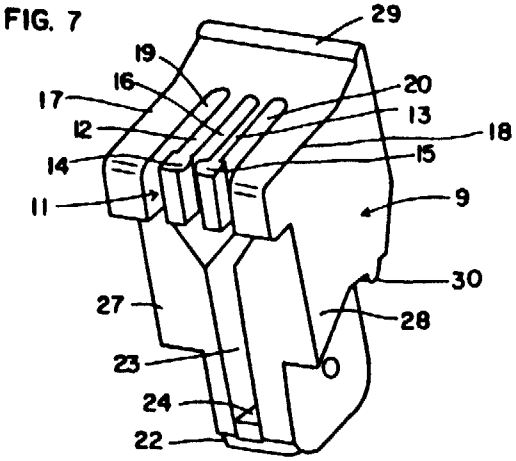
FIG. 7 is a perspective view of the ejection lever.
Figure 9:
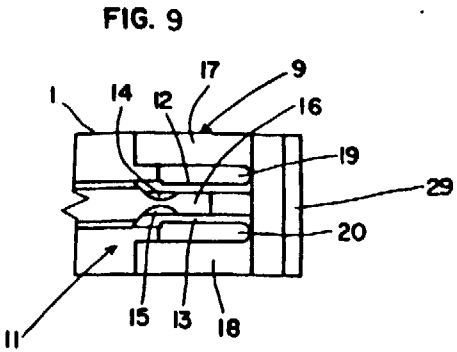
FIG. 9 is a top view of the ejection lever.
Figure 11:
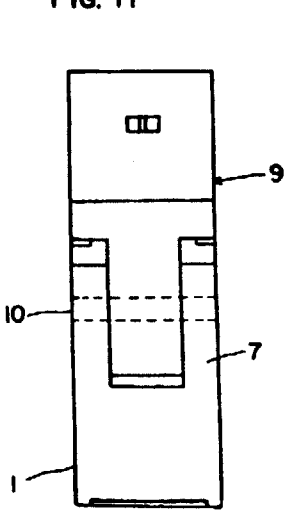
FIG. 11 is a rear view of the ejection lever.
Figure 8:
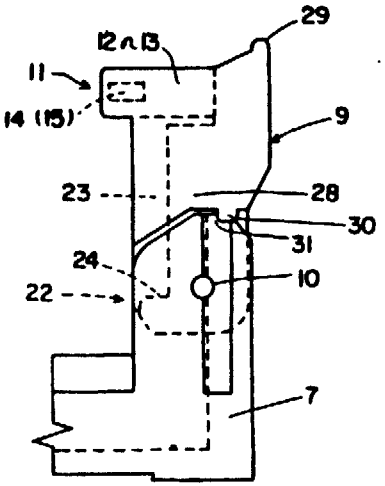
FIG. 8 is a side view of the ejection lever.
Figure 10:
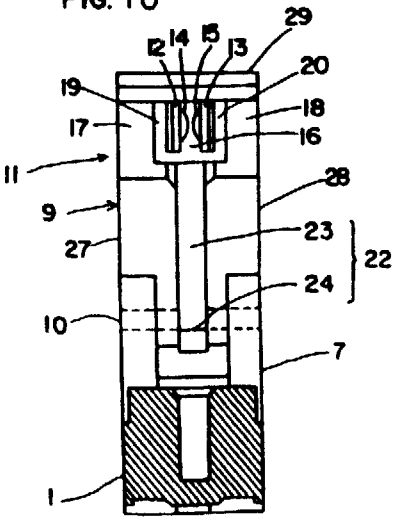
FIG. 10 is a front view of the ejection lever.

As shown in FIGS. 7 and 8, each side wall 27 or 28 may have a descending projection 30 whereas a stopper 31 may be provided to the top of each opposite extension of the housing 1. Thus, each ejection lever can be kept upright when the printed board 4 is removed from the housing 1. This upright position of each ejection lever permits easy smooth insertion of the printed board 4. The ejection lever can be made of metal or plastic.

As is apparent from the above, the lock mechanism for a card edge connector can advantageously attain dual function of locking and ejecting a printed board from the housing of another printed board, and ejection can be performed with a single easy action.

We claim:

1. A locking device for use in a card edge connector used to connect an insertable edge of one plate like object such as a first printed board to another plate like object such as a second printed board comprising:

a card edge connector having, a base portion with one edge attached to said second printed board and another edge having a slot, a plurality of female terminals extending upwardly from said base portion into said slot, and a pair of vertically spaced end plates positioned at each end of said base, said first primed board having conductors on its surfaces upon to said insertable edge positioned to mate with said female terminals and retaining holes near said insertable edge next to lateral edges thereof, a pair of locking levers opposite each other pivotally attached to said base between said end plates and rotatable in opposite directions having resilient engaging latches at the upper potion of each locking lever releasably engageable, in a direction perpendicular to the surface of said insertable printed board, with said retaining holes in said insertable printed board, and lifting fingers to the bottom of each locking lever located beneath and in contact with said insertable edge of said first primed board when said first printed board is received insand partially inserted into said slot of said edge card connector, whereby further insertion of said first printed board into said slot causes the rotation of said levers until said engaging latches contact the lateral edges of said printed board and xertion of an external force on said locking levers toward said fistprinted board causes the resilient engaging latches to further forate into engagement with both surfaces of said first prined board finally into engagement with said entraining holes in said first prined board perpendicular to the surface thereof, and, whereby, after compete insertion of said first prined board into said slot, said locking levers are rotatable so that each said upper portion can move the engaging latches out of engagement with said retaining holes and so that the lifting fingers force said first printed board out of said slot and away from said card edge connector.

2. The locking device of claim 1 wherein aid resilient engaging latches includes ramped extensions at the end of each latch having a thickness which allows the locking latches to move over the lateral edges of said first printed board, across the surface thereof and engage said retaining holes.

3. The locking device of claim 2 wherein a pair of ramped extensions are located opposite one another on said resilient engaging latches.

* * * * *